United States Patent [19]

Parks

[11] 4,224,552

[45] Sep. 23, 1980

[54] MAGNETIC FINE DEFLECTION SYSTEM COMPRISING SHEET CONDUCTORS

[75] Inventor: Harold G. Parks, Schenectady, N.Y.

[73] Assignee: General Electric Company, Schenectady, N.Y.

[21] Appl. No.: 974,655

[22] Filed: Dec. 22, 1978

[51] Int. Cl.[2] ..... H01J 29/64; H01J 29/66

[52] U.S. Cl. ..... 313/431; 313/440

[58] Field of Search ..... 313/427, 430, 431, 432, 313/433

[56] References Cited

U.S. PATENT DOCUMENTS

| | | | |
|---|---|---|---|
| 3,936,693 | 2/1976 | Parks et al. | 313/429 |
| 4,070,597 | 1/1978 | Hughes et al. | 313/432 X |
| 4,097,745 | 6/1978 | Parks | 313/431 X |
| 4,122,369 | 10/1978 | Hughes et al. | 313/431 X |

*Primary Examiner*—Robert Segal

*Attorney, Agent, or Firm*—Geoffrey H. Krauss; James C. Davis; Marvin Snyder

[57] ABSTRACT

An improved magnetic fine deflection system, for use in an electron beam optical system of the type having a single plate matrix lens, utilizes an orthogonal set of stacked deflection-field-generating conductors, with one stacked orthogonal pair of sheet conductors being positioned behind a target, upon which the electron beam is to be focused and deflected, and with a second orthogonal pair of sheet conductors positioned in front of the multi-apertured single plate matrix lens and having apertures in registration with the lenslets. The improved magnetic fine deflection system is utilized in an electron beam optical system having first means for forming a narrow beam of electrons and coarse deflection means associated with the first means for scanning the electron beam to each lenslet of the single plate matrix lens, for passage therethrough and into the magnetic fine deflection field.

7 Claims, 9 Drawing Figures

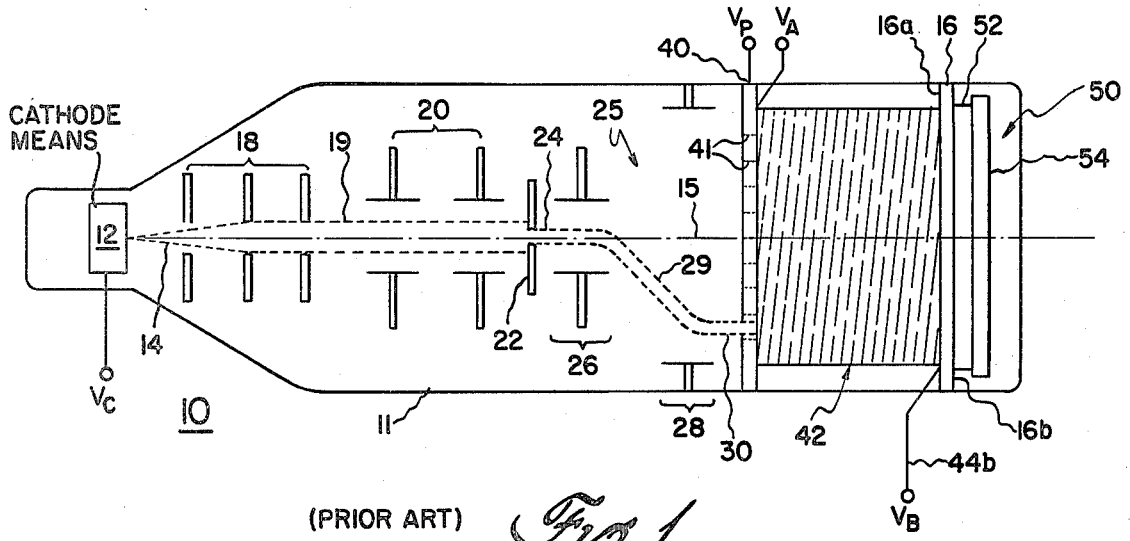
(PRIOR ART) Fig. 1
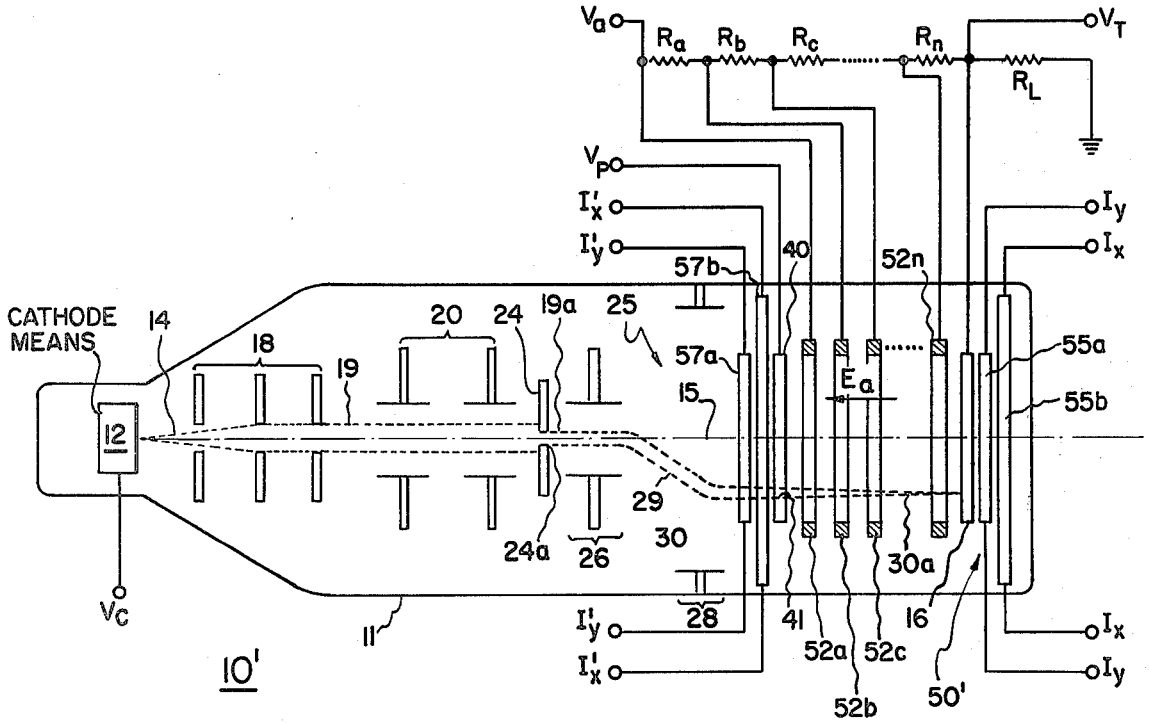
Fig. 2

Fig. 2a
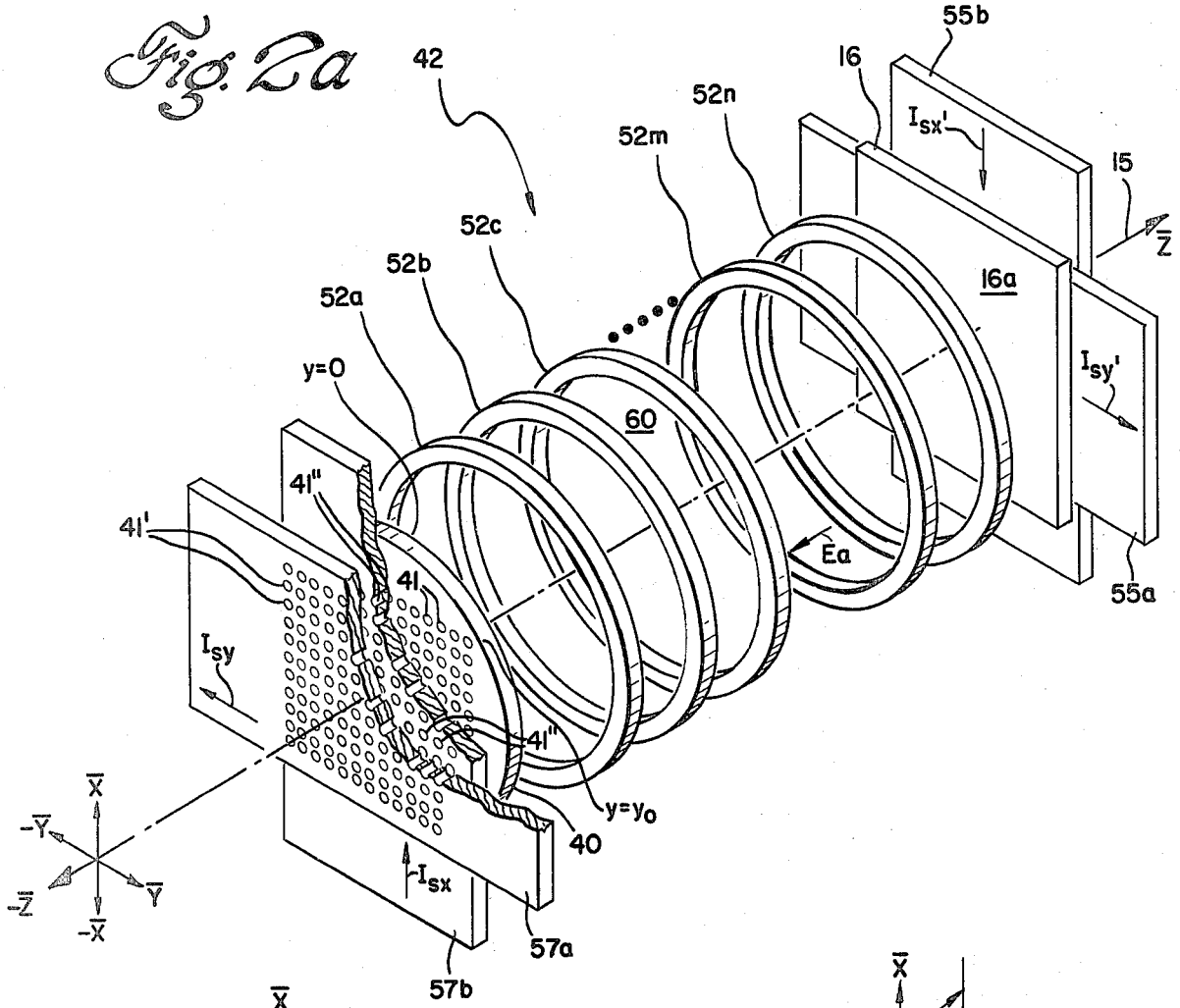
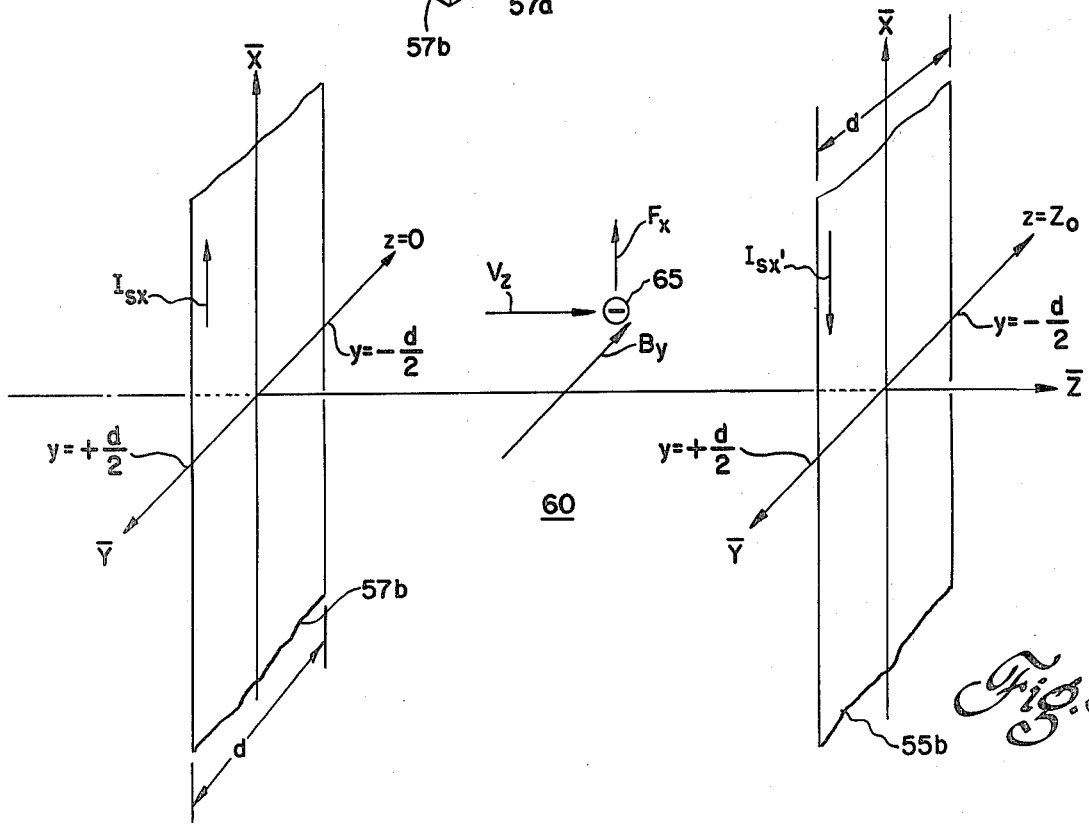
Fig. 3

MAGNETIC FINE DEFLECTION SYSTEM COMPRISING SHEET CONDUCTORS

BACKGROUND OF THE INVENTION

The present invention relates to electron optical systems and, more particularly, to a novel improved magnetic fine deflection system for use with matrix lens electron optical systems.

Modern data processing requires high capacity memory of the random-access and/or read-only types, with the memory having extremely high bit storage density and permitting rapid data storage retrieval. Memory systems of this type are disclosed in U.S. Pat. No. 3,534,219, issued Oct. 13, 1970 and assigned to the assignee of the present invention; the entire disclosure thereof is incorporated herein by reference. As disclosed and claimed in the afore-mentioned U.S. Patent, a random-access memory of the storage tube type utilizes an electron beam focusing and positioning system of the type having a coarse deflection system for causing the electron beam source to be presented to a selected one of a plurality of electron lenses arranged in the form of a two-dimensional matrix, with a second (or fine) deflection assembly positioned between the matrix lens and the data-storage target for focusing the beam passing through each single lenslet on a desired specific point of the target structure. Further improvement in the electron optics of the storage system are disclosed and claimed in U.S. Pat. No. 4,070,597, issued Jan. 24, 1978 and U.S. Pat. No. 4,122,369, issued Oct. 24, 1978, both assigned to the assignee of the present invention and both incorporated herein by reference in their entirety. In the latter-mentioned pair of U.S. Patents, a single plate matrix lens, having a multiplicity of apertures, is utilized with a means positioned between the lens plate and target for accelerating the electrons to the target, and a fine magnetic deflection means positioned under-the-target, i.e. upon the side of the target furthest from the accelerating means, lens plate and the remainder of the electron optics column. The under-the-target magnetic deflection system, having an orthogonal set of sheet conductors positioned behind the target for producing the magnetic deflection field in the region between the matrix lens plate and the target, not only requires a relatively high magnitude of deflection drive current in the sheet conductors, but also generates a fine magnetic deflection field which penetrates into the lenslet selector region about the single lens plate and extends beyond the matrix lens, in the direction of the electron source, and into the coarse deflection region, thus preventing the coarse deflection means from deflecting the collimated electron beam precisely to the center of a desired one of the multiplicity of lenslets in the matrix lens and, consequently, reducing the current of the electron beam entering the fine deflection region. It is desirable to provide a magnetic fine deflection system for use with the matrix lens electron optics, but having a reduced deflection drive current requirement and preventing magnetic fields due to the fine magnetic deflection system from penetrating into, and beyond, the lenslet selector region at the matrix lens plate.

BRIEF SUMMARY OF THE INVENTION

In accordance with the invention, an improved magnetic fine deflection system for use with matrix lens electron optics of the type having a means for providing a collimated electron beam, a target upon which an electron beam is to be focused and deflected, a matrix lens plate positioned between the electron source and the target and having a multiplicity of apertures formed into a two-dimensional array, and coarse deflection means for deflecting the collimated electron beam selectably to each of the apertures of the matrix lens plate and toward the target, includes a magnetic fine deflection system having a pair of orthogonal sets of stacked sheet conductors with one of the orthogonal stacked conductor sets being positioned adjacent a target surface furthest from the matrix lens plate and electron source, and with the other orthogonal stack conductor set being positioned between the coarse deflection means and the matrix lens plate. The stack conductors positioned adjacent to the matrix lens plate have a two-dimensional array of apertures formed therethrough in registration with the apertures of the matrix lens plate, for facilitating passage of the coarsely deflected electron beam through the stacked conductor-and-matrix lens plate arrangement and into the magnetic fine deflection region. Similarly disposed conductors of the pair of conductor sets carry sheet currents flowing in opposite directions to provide an additive magnetic fine deflection field in the region between the matrix lens plate and the target, while causing the magnetic field in the volume between the electron source and the matrix lens to be reduced. In one preferred embodiment, the sheet conductors are at least twice as wide as the greatest target or matrix lens aperture array dimensioned to provide a substantially constant magnetic field, of relatively small magnitude, between the electron source and the matrix lens plate.

Accordingly, it is one object of the present invention to provide a novel improved magnetic fine deflection system for matrix lens electron optics.

This and other objects of the present invention will become apparent upon consideration of the following detailed description, when taken in conjunction with the drawings.

BRIEF DESCRIPTION OF THE DRAWINGS

FIG. 1 is a simplified schematic side view of an entire electronic storage tube in which a single-plate lens and a prior art under-the-target deflection means are utilized;

FIG. 2 is a simplified schematic side-sectional view of an entire electronics storage tube in which the improved magnetic fine deflection of the present invention is utilized;

FIG. 2*a* is a schematic perspective view of a portion of the storage tube, illustrating the improved magnetic fine deflection apparatus of the present invention;

FIG. 3 is a perspective graphical illustration of a set of separated sheet conductors having current flow therein in opposite directions and useful in understanding the principles of the present invention;

DETAILED DESCRIPTION OF THE INVENTION

Figure 4:
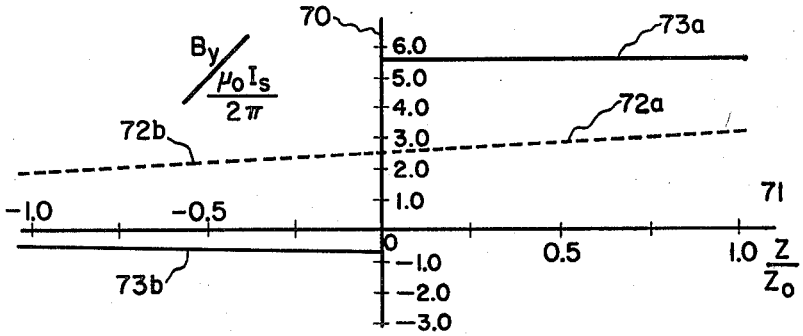
FIG. 4 is a graph illustrating the magnitude and uniformity of the magnetic fine deflection fields obtainable with the prior art under-the-target magnetic deflection and the fine deflection system of the present invention.

Referring initially to FIG. 1, an electronic storage tube 10 having the prior art under-the-target magnetic fine deflection, comprises an evacuated envelope 11 having cathode means 12 positioned at one end thereof for emitting a beam 14 of electrons along the central axis 15 of the tube toward the surface of a target 16 pc tioned the opposite end of the tube. Beam 14 is to be focused as a small spot impinging on a precisely selected area of the left-hand surface 16*a* of the target for storing a bit of information at the impingement site; the contents of the target site is subsequently read by inducing an electric current flow in the target responsive to impingment of the electron beam thereon. Beam 14 is collimated by condenser lens means 18 and the collimated beam 19 may be blanked by blanking means 20, prior to passage of the beam through a blanking plate 22 having an aperture therein of diameter determining the diameter of the emerging beam 24.

A single matrix lens plate 40 is positioned between target 16 and blanking plate 22; plate 40 contains a plurality of small apertures 41 formed therethrough and arranged in a two-dimensional array. A coarse deflection assembly 25 is comprised of deflection plate sets 26 and 28 to deflect beam 24, initially positioned along central axis 15, away from the central axis (beam 29) and thence back to a direction of travel parallel to central axis 15, as beam 30, entering one of lens plate apertures 41. Beam 30 passes through the selected lens plate aperture and encounters an electric field provided by an accelerator means 42, positioned between lens plate 40 and target 16, whereby the entering electron beam 30 is finally focused upon the left-hand target surface 16*a*. A magnetic fine deflection means 50 is provided by an orthogonally-disposed pair of sheet conductors 52 and 54, respectively, disposed in the horizontal and vertical directions, positioned adjacent the rear target surface 16*b*. A flow of current in the sheet conductors 52 and 54 produces a magnetic field within the volume between lensplate 40 and target 16 for finely deflecting the focused electron beam over a small area of target surface 16*a* associated with the lenslet aperture 41 through which beam 30 passes. Additional details describing the under-the-target fine deflection means 50, and the remainder of storage tube 10, may be found by reference to the aforementioned U.S. Pat. No. 4,122,369.

Referring now to FIGS. 2 and 2*a*, in which similar reference designations are utilized for like elements, an electronic storage tube 10' includes an improved magnetic fine deflection system 50'. Storage tube 10' has an evacuated envelope 11 containing electron source means 12 positioned at one end thereof for emitting a beam 14 of electrons along the axis 15 of tube towards a target 16 at the opposite end thereof. Electron beam 14 is collimated by condenser means 18 and the collimated beam 19 may be blanked by blanking means 20 toward an on-axis aperture 24*a* in a blanking plate 24. As in the prior art tube, the diameter of the emerging collimated beam 19*a* is determined by the diameter of blanking plate aperature 24*a*. The collimated beam 24*a* enters a coarse deflection means 25, typically having first and second coarse deflection assemblies 26 and 28 for deflecting the beam, as beam 29, away from central axis 15 and for re-deflecting the beam, as beam 30, to a direction of travel parallel to the central axis but spaced therefrom. Beam 30 is directed toward a selected one of the multiplicity of aperatures 41 in the matrix lens plate 40, positioned between coarse deflection means 25 and target 16. Plate 40 is connected to a potential $V_p$, more positive than the cathode potential $V_c$, to cause the electrons of the beam to be accelerated towards the lens plate. The electrons of beam 30 pass through the selected matrix lenslet, formed by the associated aperature 41, and are accelerated towards target 16 by electric field $E_a$, illustratively formed by a plurality of annular rings 52*a*–52*n* spaced about the volume between the matrix lens plate 40 and target 16. The target is maintained at a target potential $V_T$ and the acceleration field-producing ring 52*a*, first encountered by the electron beam exiting from a matrix lens aperture 41, is connected to an acceleration potential $V_a$, having a magnitude less than the target potential $V_T$, but greater than the matrix lens potential $V_p$. A series potential divider, comprised of resistances $R_1$–$R_n$ is utilized to provide the increasing potential for accelerator rings 52*d*–52*n*. The magnitude of the acceleration potential and the value of resistances $R_1$–$R_n$ are selected such that the beam 30*a* leaving the matrix plate is focused upon the left-hand surface of target 16.

Magnetic fine deflection means 50', for finely deflecting the focused beam 30*a* over a small area of target face 16*a*, comprises, in accordance with the invention, a first pair of orthogonally-disposed sheet conductors 55*a* and 55*b*, respectively having elongated dimensions in the horizontal and vertical planes, and spaced consecutively behind the surface of target 16 furthest from cathode means 12. A second set of orthogonally-disposed sheet conductors 57*a* and 57*b*, respectively, are respectively disposed with elongated dimensions in the horizontal and vertical direction and are positioned in front of matrix lens number 40. Each of the horizontally-disposed and vertically-disposed sheet conductor 57*a* and 57*b* respectively have a multiplicity of apertures 41' and 41'' formed respectively therethrough and arranged in a two-dimensional array with each aperture in one of the sheet conductors in registration with an aperture in the other sheet conductor and an aperture in the matrix lens plate, with all three of the apertures having the same position in the matrix of registered apertures. Thus, the coarsely deflected electron beam 30 travels parallel to central axis 15 and passes sequentially through the registered aperture set consisting of an aperture 41' in the initially-encountered horizontally-disposed sheet conductor 57*a*, and aperture 41'' in the vertically-disposed sheet conductive 57*b* and an aperture 41 in the matrix lens plate 40, prior to entering the space between the matrix lens member and the target.

The pair of horizontally-disposed sheet conductors 57*a* and 55*a*, respectively mounted in front of matrix lens 40 (on the side thereof towards cathode means 12) and behind target 16 (on the side thereof furthest from cathode means 12) each carry a substantially identical sheet current each having an opposite direction of current flow. Thus, first horizontally-disposed sheet conductor 57*a* carries a current $I_{sy}$ flowing in the $-\overline{Y}$ direction, while the other horizontally-disposed sheet conductor 55*a* carries another sheet current $I_{sy}'$, of substantially identical magnitude, but flowing in the opposite, or $+\overline{Y}$, direction. Similarly, the pair of vertically-disposed sheet conductors 57*b*, interposed between the horizontally-disposed sheet conductor 57*a* and the matrix lens plate 40, and sheet conductor 55*b*, positioned beyond horizontally-disposed sheet 55*a* and furthest from cathode means 12, carries substantially identical sheet currents $I_{sx}$ and $I_{sx}'$, flowing in opposite directions. Thus, the sheet current $I_{sx}$ in vertically-disposed sheet conductor 57b flows in the $+\overline{X}$ direction and the sheet current $I_{sx}'$ in the other vertically-disposed sheet conductor 55b flows in the $-X$ direction.

Referring now to FIG. 3, the fine deflection magnetic field produced in the fine deflection region 60, between the planes of lens member 40 and target front surface 16a, is illustrated for vertical ($\overline{X}$) deflection responsive to sheet current $I_{sx}$ in the $+\overline{X}$ direction in a first vertically-disposed sheet conductor 57b at a location $Z=0$ and a second sheet current $I_{sx}$ flowing in the $+\overline{X}$ direction in a first vertically-disposed sheet conductor 57b at a location $z=0$ and a second sheet current $I_{sx}'$ flowing in the $-\overline{X}$ direction in a second sheet conductor 55b located at $z=Z_0$. The sheet conductors 55b and 57b are of finite, but substantially identical, width d in the $\overline{Y}$ direction. Thus, both sheet conductors extend for a distance $\pm d/2$ in the $+\overline{Y}$ and $-Y$ directions, from the $\overline{X},\overline{Z}$ axes. A magnetic field of magnitude and direction $B_y$ is produced in the acceleration volume 60, parallel to the Y axis and, for an electron 65 traveling toward the target with a velocity of magnitude $V_Z$ and direction shown by arrow $V_z$, in the $+\overline{Z}$ direction, produces a fine deflection force of direction and magnitude $F_x$ in the $+\overline{X}$ direction. The components of magnetic field $B_y$ in the $\overline{X}$, $\overline{Y}$ and $\overline{Z}$ directions, from sheet conductor 57b, are given by the expressions $$B_{y(x,y,z)} = \frac{-\mu oIs}{2\pi}\left[\tan^{-1}\left(\frac{y+d/2}{z}\right) - \tan^{-1}\left(\frac{y-d/2}{z}\right)\right] \quad (1)$$

and $$B_{z(x,y,z)} = \frac{\mu oIs}{2\pi}\ln\left[\frac{z^2+(y+d/2)^2}{z^2+(y-d/2)^2}\right] \quad (2)$$

where $\mu_0$ is the permeability in free space and $I_s=I_{sx}=I_{sx}'$. The field ($B_x$) in the $\overline{X}$ direction is substantially of zero magnitude for the sheet current in both conductors 55b and 57b. The $\overline{Y}$ and $\overline{Z}$ components of the magnetic field $B_y$ due to sheet current $I_{sx}'$ flowing in the $-\overline{X}$ direction in sheet conductor 55b, are given by the expressions $$B_{y(x,y,z)} = \frac{\mu oIs}{2\pi}\left[\tan^{-1}\left(\frac{y+d/2}{z-z_o}\right) - \tan^{-1}\left(\frac{y-d/2}{z-z_o}\right)\right] \quad (3)$$

and $$B_{z(x,y,z)} = \frac{-\mu oIs}{2\pi}\ln\left[\frac{(z-z_o)^2+(y+d/2)^2}{(z-z_o)^2+(y-d/2)^2}\right] \quad (4)$$

The magnetic fine deflection fields of the vertically-disposed single conductor 54 of the prior art under-the-target deflection means 50 (FIG. 1) are given directly by Equations 3 and 4 hereinabove. The improved magnetic fine deflection apparatus 50' yields resulting magnetic fields given by the superposition of Equations 1 and 3, for the magnetic field in the $\overline{Y}$ plane, and by superposition of Equations 2 and 4 the magnetic field in the $\overline{Z}$ plane, as follows:

$$B_{y(x,y,z)} = \frac{\mu oIs}{2\pi}\left[\tan^{-1}\left(\frac{y+d/2}{z-z_o}\right) - \tan^{-1}\left(\frac{y-d/2}{z-z_o}\right) - \tan^{-1}\left(\frac{y+d/2}{z}\right) + \tan^{-1}\left(\frac{y-d/2}{z}\right)\right]$$

-continued and $$B_{z(x,y,z)} = \frac{\mu oIs}{4\pi}\left(\ln\left[\frac{z^2+(y+d/2)^2}{z^2+(y-d/2)^2}\right] - \ln\left[\frac{(z-z_o)^2+(y+d/2)^2}{(z-z_o)^2+(y-d/2)^2}\right]\right.$$

Referring now to FIG. 4, the normalized fine deflection field ($B_y/\mu_o I_s/2\pi$) magnitude is plotted for increasing values along ordinate 70, while the ratio of the distance Z to the spacing distance $Z_0$, between the lens plate and the target, is plotted along abscissa 71; positive values of the ratio ($Z/Z_0$) are in the fine deflection region 60 (the target being positioned with $Z/Z_o=1$), while negative values of the ratio are in the coarse deflection region in front of the lens plate, which itself is situated at $Z/Z_o=0$. The normalized magnetic field for the single pair of orthogonal sheet conductors of the under-the-target magnetic deflection of prior art FIG. 1 is indicated by the broken curve having a first portion 72a in the fine deflection region and a second portion 72b extending beyond the matrix lens plate 40 into the course deflection region, toward the electron source. The normalized fine-deflection magnetic field of the present invention is shown in solid curve with a first portion 73a in the fine deflection region 60 and a second, substantially smaller magnitude portion 73b in the coarse deflection region. Both curves 72 and 73 are calculated for a typical matrix lens plate-to-target distance ($Z_o$) of 600 milli-inches and for a sheet conductor width d of 2.5 inches, for a matrix lens plate having an aperture array having aperatures furthest removed for an array centerline by a distance of $\pm 0.47$ inches, and for a one-inch-square target 16. It will be seen that the fine deflection field generated by the present deflection is substantially uniform in the fine deflection region (curve 73a), whereas the fine deflection magnetic field of the single orthogonal-pair prior art magnetic deflection apparatus increases in magnittude toward the target; the magnitude of the fine deflection field generated by the present apparatus is approximately twice that of the prior art apparatus, for substantially identical sheet currents. In the coarse deflection region, it will be seen that the prior art apparatus generates a relatively greater undesirable magnetic field (curve 72b) which is non-uniform over the course deflection region and is relatively difficult to compensate for; the present apparatus generates a relatively low magnitude residual magnetic field (curve 73b) of substantially uniform magnitude, which is relatively easily compensated for in the fine deflection region. Accordingly, the fine magnetic deflection apparatus of the present invention provides an increased fine deflection sensitivity, as well as considerably reducing the deflection field leaking into the lenslet select region of the coarse deflection apparatus.

Figure 5A:
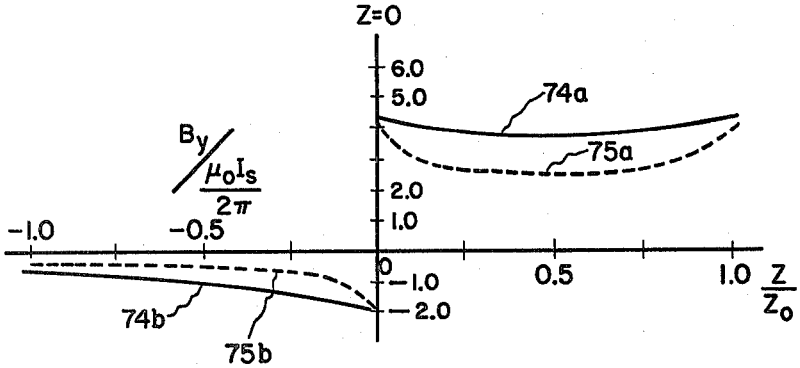
FIGS. 5*a*–5*d* are graphical illustrations of the magnetic fine deflection fields encountered by electron beams passing through lenslets at various spacings from the center axis of the matrix lens plate and for various conductor widths.
Figure 5B:
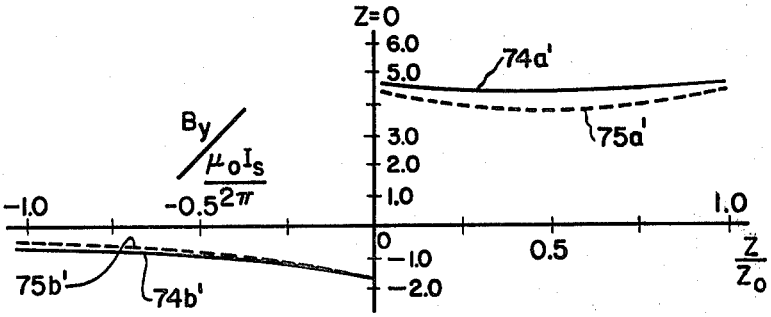
Figure 5C:
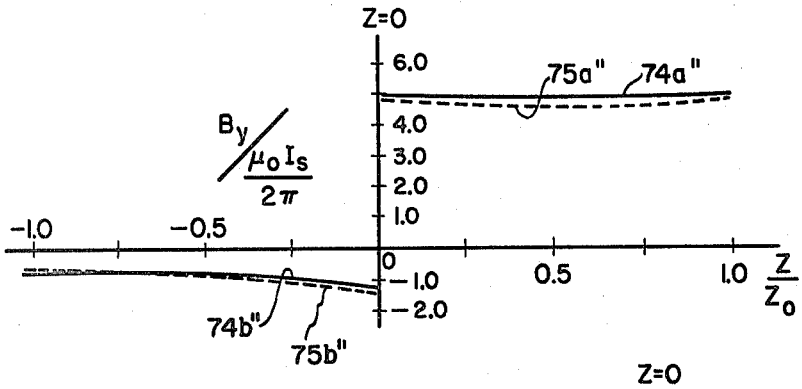
Figure 5D:
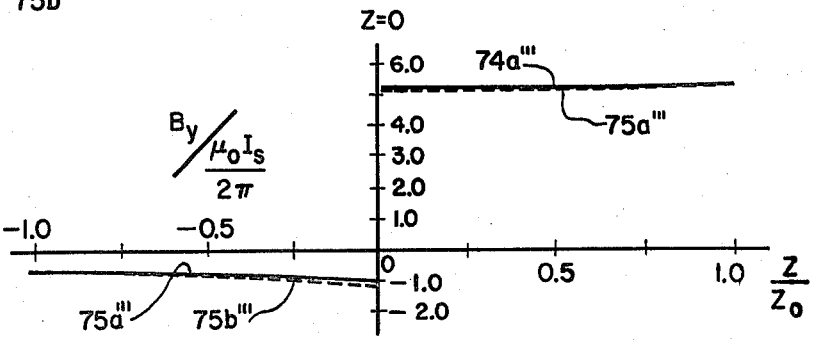

Referring now to FIGS. 5a–5d, graphical illustrations of the normalized $\overline{Y}$ fine deflection magnetic field are plotted against normalized distance between lens plate and target, for several sheet conductor widths. In FIG. 5a, the width d of each sheet conductor (illustratively, the vertically-disposed sheet conductors of FIG. 3, which pair of the set of two pairs of sheet conductors is utilized in all of FIGS. 4 and 5a–5d for purposes of comparison; it being understood that the results obtained with the horizontally disposed sheet conductors 55a and 57a are substantially identical) is 1.0" for a 1"

square target 16. The solid curve 74*a*, in the fine deflection region, and curve 74*b* in the coarse deflection region, illustrates the variation and uniformity for a lens plate aperture 41 along the vertically-disposed centerline of apertures of the array, while fine deflection region curve 75*a* and coarse deflection region curve 75*b* illustrate the normalized magnetic deflection field intensity for an aperture at extreme separation from the aperture array centerline on the lens plate, e.g. about ±0.47 inches with a 1 inch square target in the illustrated embodiment. Similarly, in FIGS. 5*b*, 5*c* and 5*d*, the width d of the sheet conductors is increased, being 1.5 inches in FIG. 5*b*, 2.0 inches in FIG. 5*c* and 2.5 inches in FIG. 5*d* with all other dimensions remaining constant. It will be seen that as the width of the sheet conductor increases, and begins to approach "infinite" width, e.g. greater than twice as wide as the corresponding dimension of the target and the lens plate aperture array, the fine deflection magnetic field 74*a*', 74*a*'' or 74*a*''' and 75*a*', 75*a*'' or 75*a*''' encountered by an electron beam passing through apertures at any location in the aperture array, with respect to the optical axis-centerline 15 of the electron optic system, are substantially identical and substantially uniform in the fine deflection region 60 (to the right of the z=0 axis) and the reduced field 74*b*', 74*b*'' or 74*b*''' and 75*b*', 75*b*'' and 75*b*''', penetrating into the coarse deflection region (to the left of the lens plate and z=0 axis) is also substantially uniform, and is relatively easily compensatable.

The present invention has been set forth herein with particular reference to one presently preferred embodiment; many modifications and variations will now occur to those skilled in the art. It is my intent, therefore, to be limited only by the scope of the appending claims and not by the details of the specific embodiment set forth herein.

What is claimed is:

1. Improved magnetic fine deflection apparatus for an electron optical system of the type having a matrix lens member positioned substantially transverse to a system axis and having an array of a plurality of apertures formed therethrough, means for emitting a beam of electrons toward said matrix lens member, coarse deflector means for deflecting the electron beam through a selected one of the plurality of apertures toward the surface of a target positioned transverse to said system axis and beyond said lens member with respect to said source means, and means for focusing the beam upon said target surface after passage of said beam through said selected aperture, said fine deflection apparatus comprising:

first means comprising first and second orthogonally-disposed sheet conductors, each lying in a plane substantially transverse to said system axis, and positioned beyond said target, with respect to said lens member, for generating a first magnetic fine deflection field substantially in a direction transverse to said system axis; and second means comprising third and fourth sheet conductors orthogonally-disposed in a plane substantially transverse to said system axis; said first and third sheet conductors extending substantially parallel to one another; said second and fourth sheet conductors extending substantially parallel to one another; each of said third and fourth sheet conductors having an array of apertures formed therethrough with each aperture in registration with an associated aperture in the other of said third and fourth sheet conductors and with an associated aperture of said lens member; said second means being positioned beyond said lens member, with respect to said target, for generating a second magnetic fine deflection field substantially in said direction transverse to said system axis;

said first and second fields adding in a first region between said lens member and said target for finely deflecting electrons of said beam to impinge upon a selected point upon said target surface; the magnitude of said second magnetic field in a second region beyond said lens member, with respect to said target, being reduced by the magnitude of said first field in said second region to reduce errors in the deflection of said beam to said selected aperture by said coarse deflector means.

2. The improved deflection apparatus set forth in claim 1, wherein the width of each of said first through fourth sheet conductors, in a direction in a plane thereof and transverse to the elongation direction thereof, is at least twice as great as the larger of the maximum dimension of said lens member aperture array and said target in the same direction as the sheet conductor width.

3. The improved deflection apparatus set forth in claim 2, wherein first and third sheet conductors have the same width.

4. The improved deflection apparatus set forth in claim 2, wherein second and fourth sheet conductors have the same width.

5. The improved deflection apparatus set forth in claim 2, wherein the widths of each of said first through fourth sheet conductors is about two and one half times as great as said larger dimension of said lens member and said target.

6. The improved deflection apparatus of claim 2, wherein said first and third sheet conductors have substantially identical deflection currents flowing in opposite directions therethrough.

7. The improved deflection apparatus of claim 2 wherein said second and fourth sheet conductors have substantially identical deflection currents flowing in opposite directions therethrough.

* * * * *